United States Patent [19]

Schoerner et al.

[11] 4,080,222

[45] * Mar. 21, 1978

[54] ALUMINUM-IRON-NICKEL ALLOY ELECTRICAL CONDUCTOR

[75] Inventors: Roger J. Schoerner; Enrique C. Chia, both of Carrollton, Ga.

[73] Assignee: Southwire Company, Carrollton, Ga.

[ * ] Notice: The portion of the term of this patent subsequent to Apr. 30, 1991, has been disclaimed.

[21] Appl. No.: 639,077

[22] Filed: Dec. 9, 1975

Related U.S. Application Data

[60] Continuation-in-part of Ser. No. 447,462, Mar. 1, 1974, abandoned, which is a division of Ser. No. 150,724, Jun. 7, 1971, abandoned, which is a continuation-in-part of Ser. No. 147,196, May 26, 1971, abandoned.

[51] Int. Cl.[2] ..... C22F 1/04

[52] U.S. Cl. ..... 148/2; 29/527.7; 75/138; 75/147; 75/148; 148/11.5 A; 148/32

[58] Field of Search ..... 75/138–148; 148/2, 11.5 A, 32, 32.5; 29/527.7; 164/76

[56] References Cited

U.S. PATENT DOCUMENTS

| | | | |
|---|---|---|---|
| 1,579,481 | 4/1926 | Hybinette | 75/138 |
| 1,945,297 | 1/1934 | Sterner-Rainer | 75/147 |
| 3,670,401 | 6/1972 | Schoerner | 148/2 |
| 3,697,260 | 10/1972 | Hunsicker | 75/142 |
| 3,807,969 | 4/1974 | Schoerner et al. | 148/2 |

*Primary Examiner*—R. Dean

*Attorney, Agent, or Firm*—Herbert M. Hanegan; Stanley L. Tate; R. Steven Linne

[57] ABSTRACT

This disclosure relates to an aluminum alloy electrical conductor which contains from about 0.20% to about 1.60% by weight nickel, from about 0.30% to about 1.30% iron, optionally up to 2.00% of additional specified alloying elements, and the remainder aluminum with associated trace elements. The conductors are processed in a continuous operation which includes continuous casting, hot-rolling in the as-cast condition to form continuous rod, cold-working of the rod by drawing it through a series of wire-drawing dies, without preliminary or intermediate anneals, and thereafter annealing the wire to achieve a minimum electrical conductivity of 58% IACS, an ultimate tensile strength of at least 12,000 psi, a yield strength of at least 8,000 psi and an elongation of at least 12% when measured as a No. 10 AWG wire. The additional alloying elements are precisely controlled in order to facilitate the continuous processing of the cast bar without splitting and cracking of the subsequently rolled and cold-drawn rod.

11 Claims, No Drawings

ALUMINUM-IRON-NICKEL ALLOY ELECTRICAL CONDUCTOR

CROSS-REFERENCE TO RELATED APPLICATIONS

This application is a continuation-in-part of copending application Ser. No. 447,462, filed Mar. 1, 1974, abandoned which in turn was a division of Ser. No. 150,724, filed June 7, 1971, which in turn is a continuation-in-part of Ser. No. 147,196, filed May 26, 1971, both now abandoned.

DESCRIPTION OF THE PREFERRED EMBODIMENTS

The present invention relates to an improved aluminum alloy electrical conductor, and the continuous method of production thereof in the form of a rod or wire.

Aluminium base alloys are finding wider acceptance in the marketplace of today because of their light weight and low cost. One area where aluminum alloys have found increasing acceptance is in the replacement of copper in the manufacture of electrically conductive wire. Conventional electrically conductive aluminum alloy wire (referred to as EC) contains a substantial amount of pure aluminum and trace amounts of impurities such as silicon, vanadium, iron, copper, manganese, magnesium, zinc, born, and titanium.

Even though desirable in terms of weight and cost, aluminum alloys have received far less than complete acceptance in the electrical conductor marketplace. One of the chief reasons for the lack of complete acceptance is the range of physical properties available with conventional EC aluminum alloy conductors. If the physical properties, such as thermal stability, tensile strength, percent elongation, ductility and yield strength, could be improved significantly without substantially lessening the electrical conductivity of the finished product, a very desirable improvement would be achieved. It is accepted, however, that addition of alloying elements, as in other aluminum alloys, reduces conductivity while improving the physical properties. Consequently, only these additions of elements which improve physical properties without substantially lessening conductivity will yield an acceptable and useful product.

It is an object of the present invention, therefore, to provide a new aluminum alloy electrical conductor which combines improved physical properties with acceptable electrical conductivity. These and other objects, features and advantages of the present invention will be apparent from a consideration of the following detailed description of an embodiment of the invention.

In accordance with the invention, the present aluminum base alloy is prepared by mixing nickel, iron and optionally other alloying elements, in closely controlled amounts, with aluminum in a furnace to obtain a melt having requisite percentages of elements. It has been found that suitable results are obtained with nickel present in a weight percentage of from about 0.20 percent to about 1.60 percent. Superior results are achieved when nickel is present in a weight percentage of from about 0.50 percent to about 1.00 percent and particularly superior and preferred results are obtained when nickel is present in a percentage by weight of from about 0.60 percent to about 0.80 percent.

Suitable results are obtained with iron present in a weight percentage of from about 0.30 percent to about 1.30 percent. Superior results are achieved when iron is present in a weight percentage of from about 0.40 percent to about 0.80 percent and particularly superior and preferred results are obtained when iron is present in a percentage by weight of from about 0.45 percent to about 0.65 percent.

The aluminum content of the present alloy may vary from about 97.00 percent to about 99.50 percent by weight with superior results being obtained when the aluminum content varies between about 97.80% and about 99.20% by weight. Since the percentage for maximum and minimum aluminum do not correspond with the maximums and minimums for alloying elements, it should be apparent that suitable results are not obtained if the maximum percentage for all alloying elements are employed. If commercial aluminum is employed in preparing the present melt, it is preferred that the aluminum prior to adding to the melt in the furnace, contain no more than 0.10 percent total of trace impurities.

Optionally the present alloy may contain an additional alloying element or group of alloying elements. The total concentration of the optional alloying elements may be up to about 2.00 percent by weight; preferably from about 0.10 percent to about 1.50 percent by weight is employed. Particularly superior and preferred results are obtained when from about 0.10 percent to about 1.00 percent by weight of total additional alloying elements is employed.

Additional alloying elements include the following:

| ADDITIONAL ALLOYING ELEMENTS | | |
|---|---|---|
| Magnesium | Cesium | Dysprosium |
| Cobalt | Yttrium | Terbium |
| Copper | Scandium | Erbium |
| Silicon | Thorium | Neodynium |
| Zirconium | Tin | Indium |
| Cerium | Zinc | Boron |
| Niobium | Bismuth | Thallium |
| Hafnium | Antimony | Rubidium |
| Lanthanum | Vanadium | Titanium |
| Tantalum | Rhenium | Carbon |

Other elements may be present in trace amounts provided that they do not adversely affect the mechanical, electrical and physical properties of the product.

Superior results are obtained with the following additional alloying elements in the percentages, by weight, as shown:

| PREFERRED ADDITIONAL ALLOYING ELEMENTS | |
|---|---|
| Magnesium | 0.001 to 1.00% |
| Cobalt | 0.001 to 1.00% |
| Copper | 0.001 to 0.05% |
| Silicon | 0.05 to 1.00% |
| Zirconium | 0.01 to 1.00% |
| Niobium | 0.01 to 2.00% |
| Tantalum | 0.01 to 2.00% |
| Yttrium | 0.01 to 1.00% |
| Scandium | 0.01 to 1.00% |
| Thorium | 0.01 to 1.00% |
| Rare Earth Metals | 0.01 to 2.00% |
| Carbon | 0.01 to 1.00% |

Particularly superior and preferred results are obtained with the use of cobalt or magnesium as the additional alloying element. Suitable results are obtained with magnesium or cobalt in a percentage range of from about 0.001% to about 1.00% by weight with superior results being obtained when from about 0.025% to about 0.50% by weight is used. Particularly superior and preferred results are obtained when from about 0.03% to about 0.10% by weight of magnesium or cobalt is employed. When Si exceeds 0.15% the Mg must be limited to less than 0.1%. Otherwise the product will exhibit an insufficient ductility subsequent to cold drawing, if previously continuously cast and rolled.

It has been further determined in accordance with this invention that the copper content must be very closely controlled, within the range specified above, in order to permit continuous processing of the product. Although copper is an effective hardening element, if more than 0.05% copper is present in the alloy of this invention, it will form extremely hard cuprous oxide particles that will result in splitting and cracking when the continuously processed product is rolled and cold drawn. Since a conventionally processed product can be homogenized prior to rolling to refine the grain structure, the copper content thereof need not be so closely controlled. However, when the product is continuously processed in accordance with the instant invention, the cast bar is substantially immediately rolled in the as-cast condition and thus does not have the benefit of an homogenizing step. Consequently, the copper content of the alloy must be closely controlled to avoid the brittleness which leads to splitting and cracking of the bar when processed according to the method of this invention.

It should be understood that the addional alloying elements may be present either individually or as a group of two or more of the elements. It should be understood, however, that if two or more of the additional alloying elements are employed, the total concentration of additional alloying elements should not exceed about 2.00 percent by weight.

After preparing the melt, the aluminum alloy is continuously cast into a continuous bar by a continuous casting machine and then substantially immediately thereafter, hot-worked in a rolling mill to yield a continuous aluminum alloy rod. One example of a continuous casting and rolling operation capable of producing continuous rod as specified in this application is contained in the following paragraphs:

A continuous casting machine serves as a means for solidifying the molten aluminum alloy metal to provide a cast bar that is conveyed in substantially the condition in which it solidified from the continuous casting machine to the rolling mill, which serves as a means for hot-forming the cast bar into rod or another hot-formed product in a manner which imparts substantial movement to the cast bar along a plurality of angularly disposed axes.

The continuous casting machine is of conventional casting wheel type having a casting wheel with a casting groove in its periphery which is partially closed by an endless belt supported by the casting wheel and an idler pulley. The casting wheel and the endless belt cooperate to provide a mold into one end of which the cast bar is emitted in substantially that condition in which it is solidified.

The rolling mill is of conventional type having a plurality of roll stands arranged to hot-form the cast bar by a series of deformations. The continuous casting machine and the rolling mill are positioned relative to each other so that the cast bar enters the rolling mill substantially immediately after solidification and in substantially that condition in which it solidified. In this condition, the cast bar is at a hot-forming temperature within the range of temperatures for hot-forming the cast bar at the initiation of hot-forming without heating between the casting machine and the rolling mill. In the event that it is desired to closely control the hot-forming temperature of the cast bar within the conventional range of hot-forming temperatures, means for adjusting the temperature of the cast bar may be placed between the continuous casting machine and the rolling mill without departing from the inventive concept disclosed herein.

The roll stands each include a plurality of rolls which engage the cast bar. The rolls of each roll stand may be two or more in number and arranged diametrically opposite from one another or arranged at equally spaced positions about the axis of movement of the cast bar through the rolling mill. The rolls of each roll stand of the rolling mill are rotated at a predetermined speed by a power means such as one or more electric motors and the casting wheel is rotated at a speed generally determined by its operating characteristics. The rolling mill serves to hot-form the cast bar into a rod of a cross-sectional area substantially less than that of the cast bar as it enters the rolling mill.

The peripheral surfaces of the rolls of adjacent roll stands in the rolling mill change in configuration; that is, the cast bar is engaged by the rolls of successive roll stands with surfaces of varying configuration, and from different directions. This varying surface engagement of the cast bar in the roll stands function to knead or shape the metal in the cast bar in such a manner that it is worked at each roll stand and also to simultaneously reduce and change the cross-sectional area of the cast bar into that of the rod.

As each roll stand engages the cast bar, it is desirable that the cast bar be received with sufficient volume per unit of time at the roll stand for the cast bar to generally fill the space defined by the rolls of the roll stand so that the rolls will be effective to work the metal in the cast bar. However, it is also desirable that the space defined by the rolls of each roll stand not be overfilled so that the cast bar will not be forced into the gaps between the rolls. Thus, it is desirable that the rod be fed toward each roll stand at a volume per unit of time which is sufficient to fill, but not overfill, the space defined by the rolls of the roll stand.

As the cast bar is received from the continuous casting machine, it usually has one large flat surface corresponding to the surface of the endless band and inwardly tapered side surfaces corresponding to the shape of the groove in the casting wheel. As the cast bar is compressed by the rolls of the roll stands, the cast bar is deformed so that it generally takes the cross-sectional shape defined by the adjacent peripheries of the rolls of each roll stand.

Thus, it will be understood that with this apparatus, cast aluminum alloy rod of an infinite number of different lengths is prepared by simultaneous casting of the molten aluminum alloy and hot-forming or rolling the cast aluminum bar. The continuous rod has a minimum electrical conductivity of 57 percent IACS and may be used in conducting electricity or it may be drawn to wire of a smaller cross-sectional diameter.

To produce wire of various gauges, the continuous rod produced by the casting and rolling operation is processed in a reduction operation. The unannealed rod (i.e., as rolled to *f* temper) is cold-drawn through a series of progressively constricted dies, without preliminary or intermediate anneals, to form a continuous wire of desired diameter. It has been found that the elimination of intermediate anneals improves the physical properties of the wire. Processing with intermediate anneals is acceptable when the requirements for physical properties of the wire permit reduced values. The conductivity of the harddrawn wire is at least 57 percent IACS. If greater conductivity or increased elongation is desired, the wire may be annealed or partially annealed after the desired wire size is obtained and cooled. Fully annealed wire has a conductivity of at least 58 percent IACS. At the conclusion of the drawing operation and optional annealing operation, it is found that the alloy wire has the properties of improved tensile strength and yield strength together with improved thermal stability, percent ultimate elongation and increased ductility and fatigue resistance as specified previously in this application. The annealing operation may be continuous as in resistance annealing, induction annealing, convection annealing by continuous furnaces or radiation annealing by continuous furnaces, or, preferably, may be batch annealed in a batch furnace. When continuously annealing, temperatures of about 450° F to about 1200° F may be employed with annealing times of about five minutes to about 1/10,000 of a minute. Generally, however, continuous annealing temperatures and times may be adjusted to meet the requirements of the particular overall processing operation so long as the desired physical properties are achieved. In a batch annealing operation, a temperature of approximately 400° F to about 750° F is employed with residence times of about thirty (30) minutes to about twenty-four (24) hours. As mentioned with respect to continuous annealing, in batch annealing the times and temperatures may be varied to suit the overall process so long as the desired physical properties are obtained.

It has been found that the properties of a No. 10 gauge AWG fully annealed soft wire of the present alloy vary between the following figures:

| Conductivity | Tensile Strength psi | % Elongation | Yield Strength psi |
|---|---|---|---|
| 58%–63% | 12,000–24,000 | 12%–30% | 8,000–18,000 |

A more complete understanding of the invention will be obtained from the following example:

EXAMPLE NO. 1

Various melts were prepared by adding the required amount of alloying elements to 1816 grams of molten aluminum, containing less than 0.10% trace element impurities, to achieve a percentage concentration of elements as shown in the accompanying table; the remainder being aluminum. Graphite crucibles are used except in those cases where the alloying elements are known carbide formers, in which cases aluminum oxide crucibles are used. The melts are held for sufficient times and at sufficient temperatures to allow complete solubility of the alloying elements with the base aluminum. An argon atmosphere is provided over the melt to provide oxidation. Each melt is continuously cast on a continuous casting machine and immediately hot-rolled through a rolling mill to ⅜ inch continuous rod. The hard rod was then cold drawn, without any preliminary or intermediate anneals, into 0.1019 inch, 10 gauge AWG wire. The wire was then given a final anneal for five hours at 650° F resulting in soft wire.

The types of alloys employed and the results of the tests performed thereon are as follows:

TABLE 1

| Ni | Fe | UTS | %Elong. | %IACS |
|---|---|---|---|---|
| .30 | 1.00 | 17,500 | 12.5 | 60.49 |
| .80 | .60 | 18,300 | 25.6 | 59.73 |
| 1.00 | .60 | 17,900 | 26.1 | 59.97 |
| 1.50 | .40 | 17,800 | 24.8 | 59.52 |

% Elong. = Percent Ultimate Elongation
UTS = Ultimate Tensile Strength
% IACS = Conductivity

EXAMPLE NO. 2

An additional alloy melt was prepared according to Example No. 1 so that the composition was as follows in weight percent:

Nickel — 0.60%
Iron — 0.90%
Magnesium — 0.15%
Aluminum — Remainder

The melt was processed to a No. 10 gauge soft wire. The physical properties of the wire were as follows:

Ultimate Tensile Strength — 18,200 psi
Percent Ultimate Elongation — 25.2%
Conductivity — 59.10% IACS

EXAMPLE NO. 3

An additional alloy melt was prepared according to Example No. 1 so that the composition was as follows in weight percent:

Nickel — 0.40%
Iron — 1.10%
Aluminum — Remainder

The melt was processed to a No. 10 gauge soft wire. The physical properties of the wire were as follows:

Ultimate Tensile Strength — 17,400 psi
Percent Ultimate Elongation — 14.1%
Conductivity — 60.30% IACS

EXAMPLE NO. 4

An additional alloy melt was prepared according to Example No. 1 so that the composition was as follows in weight percent:

Nickel — 1.60%
Iron — 0.30%
Aluminum — Remainder

The melt was processed to a No. 10 gauge soft wire. The physical properties of the wire were as follows:

Ultimate Tensile Strength — 17,200 psi
Percent Ultimate Elongation — 27.5%
Conductivity — 59.1% IACS

EXAMPLE NO. 5

An additional alloy melt was prepared according to Example No. 1 so that the composition was as follows in weight percent:

Nickel — 0.20%
Iron — 1.30%
Aluminum — Remainder

The melt was processed to a No. 10 gauge soft wire. The physical properties of the wire were as follows:

Ultimate Tensile Strength — 17,500 psi
Percent Ultimate Elongation — 13.5%
Conductivity — 61.05% IACS

EXAMPLE NO. 6

An additional alloy melt was prepared according to Example No. 1 so that the composition was as follows in weight percent:

Nickel — 0.80%
Iron — 0.45%
Cobalt — 0.10%
Aluminum — Remainder

The melt was processed to a No. 10 gauge soft wire. The physical properties of the wire were as follows:

Ultimate Tensile Strength — 17,850 psi
Percent Ultimate Elongation — 23.6%
Conductivity — 59.8$IACS Through testing and analysis of an alloy containing 0.80 weight percent nickel, 0.30 weight percent iron, and the remainder aluminum, it has been found that the present aluminum base alloy after cold working includes intermetallic compound precipitates. One of the compounds is identified as nickel aluminate ($NiAl_3$) and the other is identified as iron aluminate ($FeAl_3$). The nickel intermetallic compound is found to be very stable and especially so at high temperatures. The nickel compound also has a low tendency to coalesce during annealing of products formed from the alloy and the compound is generally incoherent with the aluminum matrix. The mechanism of strenthening for this alloy is in part due to the dispersion of the nickel intermetallic compound as a precipitate throughout the aluminum matrix. The precipitate tends to pin dislocation sites which are created during cold working of the wire formed from the alloy. Upon examination of the nickel intermetallic compound precipitate in a cold drawn wire, it is found that the precipitates are oriented in the direction of drawing. In addition, it is found that the precipitates can be rod-like, plate-like, or spherical in configuration.

Other intermetallic compounds may also be formed depending upon the constituents of the melt and the relative concentrations of the alloying elements. Those intermetallic compounds include the following: $Ni_2Al_3$, MgCoAl, $Fe_2Al_5$, $Co_2Al_9$, $Co_4Al_{13}$, $CeAl_4$, $CeAl_2$, $VAl_{11}$, $VAl_7$, $VAl_6$, $VAl_3$, $VAl_{12}$, $Zr_3Al$, $Zr_2Al$, $LaAl_4$, $Al_3Ni_2$, $Al_2Fe_5$, $Fe_3NiAl_{10}$, $Co_2Al_5$, $FeNiAl_9$.

The iron aluminate intermetallic compound also contributes to the pinning of dislocation sites during cold working of the wire. Upon examination of the iron intermetallic compound precipitate in a cold drawn wire, it is found that the precipitates are substantially evenly distributed through the alloy and have a particle size of less than 1 micron. If the wire is drawn without any intermediate anneals, the particle size of the iron intermetallic compounds is less than 2,000 angstroms.

A characteristic of high conductivity aluminum alloy wires which is not indicated by the historical tests for tensile strength, percent elongation and electrical conductivity is the possible change in properties as a result of increases, decreases, of fluctuations of the temperature of the strands. It is apparent that the maximum operating temperature of a strand or series of strands will be affected by this temperature characteristic. The characteristic is also quite significant from a manufacturing viewpoint since many insulation processes require high temperature thermal cures.

It has been found that the aluminum alloy wire of the present invention has a characteristic of thermal stability which exceeds the thermal stability of conventional aluminum alloy wires.

For the purpose of clarity, the following terminology used in this application is explained as follows:

Aluminum alloy rod — A solid product that is long in relation to its cross-section. Rod normally has a cross-section of between three inches and 0.375 inches.

Aluminum alloy wire — A solid wrought product that is long in relation to its cross-section, which is square or rectangular with sharp or rounded corners or edges, or is round, a regular hexagon or a regular octagon, and whose diameter or greatest perpendicular distance between parallel faces is between 0.374 inches and 0.0031 inches.

While this invention has been described in detail with particular reference to preferred embodiments thereof, it will be understood that variations and modifications can be effected within the spirit and scope of the invention as described hereinbefore and as defined in the appended claims.

We claim:

1. The method of preparing an aluminum alloy conductor having a minimum conductivity of at least 58 percent IACS comprising the steps of:

(a) Alloying from about 0.20 to about 1.60 weight percent nickel, from about 0.30 to about 1.30 weight percent iron, more than 0.15 to about 1.00 weight percent silicon, less than 0.10 weight percent magnesium, less than 0.05 weight percent copper, and from about 97.00 to about 99.50 weight percent aluminum with associated trace elements;

(b) Casting the alloy in a moving mold formed between a groove in the periphery of a rotating casting wheel and a metal belt lying adjacent said groove for a portion of its length; and (c) Hot rolling the cast alloy substantially immediately after casting while the cast alloy is in substantially that condition as cast to form a continuous rod;

said aluminum alloy conductor having good thermal stability, a tensile strength of at least 12,000 psi, and a yield strength of at least 8,000 psi when measured as a fully annealed wire. cm 2. The method according to claim 1 further including the step of drawing said rod through wire-drawing dies, without annealing between drawing dies, to form wire of finish gauge size.

2. The method according to claim 1 further including the step of drawing said rod through wire-drawing dies, without annealing between drawing dies, to form wire of finish gauge size.

3. The method according to claim 1 wherein nickel, iron and silicon are alloyed with aluminum to yield the following composition:

Nickel — 0.60% to 0.80%, by weight
Iron — 0.45% to 0.65%, by weight
Silicon — more than 0.15 to 1.00%, by weight
Aluminum — remainder.

4. The method according to claim 1 wherein the alloying step includes the addition of magnesium in an amount sufficient to yield an alloy having the following weight percentages:

Nickel — 0.60% to 0.80%
Iron — 0.45% to 0.65%
Magnesium — 0.03% to less than 0.10%
Silicon — more than 0.15% to 1.00%
Aluminum — remainder.

5. The method according to claim 1 wherein the alloying step includes the addition of niobium and tantalum in an amount sufficient to yield an alloy having the following weight percentages:

Nickel — 0.60%
Iron — 0.65%
Silicon — more than 0.15% to 1.00%
Niobium — 0.30%
Tantalum — 0.18%
Aluminum — remainder.

6. The method according to claim 1 wherein the alloying step includes the addition of zirconium in an amount sufficient to yield an alloy having the following weight percentages:

Nickel — 0.80%
Iron — 0.45%
Silicon — more than 0.15% to 1.00%
Zirconium — 0.60%
Aluminum — remainder.

7. The method according to claim 1 including the further step of:

(d) drawing the rod through wire-drawing dies, without annealing the rod between drawing dies, to form wire; said wire having the following properties when measured as a No. 10 A.W.G. fully annealed wire:

Tensile strength: 12,000 - 24,000 psi
Elongation: 12% - 30%
Yield strength: 8,000 - 18,000 psi.

8. An aluminum alloy electrical conductor manufactured according to the method of claim 1 having a minimum electrical conductivity of 58% IACS, an ultimate tensile strength of at least 12,000 psi, a yield strength of at least 8,000 psi and an elongation of at least 12% when measured as a fully annealed No. 10 AWG wire.

9. Aluminum alloy electrical conductor of claim 8 wherein the weight percentages of the constituents are as follows:

Nickel — 0.60% to 0.80%
Iron — 0.45% to 0.65%
Magnesium — 0.03% to less than 0.10%
Silicon — more than 0.15% to 1.00%
Aluminum — 97.80% to 99.20%.

10. Aluminum alloy electrical conductor of claim 8 wherein an additional alloying element is present and selected from the group consisting of the following elements in a weight percentage as shown for each element:

Magnesium — 0.001 to less than 0.10%
Zirconium — 0.01 to 1.00%
Niobium — 0.01 to 2.00%
Tantalum — 0.01 to 2.00%
Yttrium — 0.01 to 1.00%
Scandium — 0.01 to 1.00%
Thorium — 0.01 to 1.00%
Rare Earth Metals — 0.01 to 2.00%
Carbon — 0.01 to 1.00%
Mixtures of two or more of the above — 0.01 to 2.00%.

11. Aluminum alloy electrical conductor of claim 8 wherein the conductor is a fully annealed wire which has been cold drawn to finished wire size, without any preliminary or intermediate anneals, prior to the final anneal.

* * * * *